US008248199B2

(12) United States Patent
Tamura et al.

(10) Patent No.: US 8,248,199 B2
(45) Date of Patent: Aug. 21, 2012

(54) TERMINAL MEMBER AND COIL ASSEMBLY USING THE SAME

(75) Inventors: Akimasa Tamura, Osaka (JP); Hitoshi Takahashi, Osaka (JP); Keisuke Warashina, Chachoengsao (TH)

(73) Assignee: Tabuchi Electric Co., Ltd., Osaka (JP)

( * ) Notice: Subject to any disclaimer, the term of this patent is extended or adjusted under 35 U.S.C. 154(b) by 0 days.

(21) Appl. No.: 12/433,519

(22) Filed: Apr. 30, 2009

(65) Prior Publication Data

US 2009/0212896 A1 Aug. 27, 2009

Related U.S. Application Data

(63) Continuation of application No. PCT/JP2007/001198, filed on Nov. 1, 2007.

(30) Foreign Application Priority Data

Nov. 2, 2006 (JP) ..... 2006-299354

(51) Int. Cl.

| | |
|---|---|
| ***H01F 27/04*** | (2006.01) |
| ***H01F 27/29*** | (2006.01) |
| ***H01R 4/00*** | (2006.01) |
| ***H01R 4/02*** | (2006.01) |

(52) U.S. Cl. ..... 336/107; 336/192; 174/84 R; 174/84 C; 439/874

(58) Field of Classification Search ..... 336/107, 336/192; 174/84 R, 84 C; 439/874, 875
See application file for complete search history.

(56) References Cited

U.S. PATENT DOCUMENTS

| | | | | |
|---|---|---|---|---|
| 3,189,857 | A | 6/1965 | Jones | |
| 3,496,504 | A * | 2/1970 | Daley | 336/96 |
| 4,581,820 | A | 4/1986 | Zahn et al. | |
| 5,097,242 | A * | 3/1992 | Onishi et al. | 336/192 |
| 5,959,587 | A * | 9/1999 | McHenry et al. | 343/713 |
| 6,093,036 | A | 7/2000 | Tohgo et al. | |
| 7,034,756 | B2 * | 4/2006 | Fujii et al. | 343/713 |
| 7,354,283 | B2 * | 4/2008 | Onuma et al. | 439/92 |
| 2003/0190846 | A1 | 10/2003 | Costa | |
| 2004/0058587 | A1 | 3/2004 | Huang | |

FOREIGN PATENT DOCUMENTS

| | | | |
|---|---|---|---|
| CN | 1219007 | A | 6/1999 |
| JP | 3-65209 | U | 6/1991 |
| JP | 05-303982 | A | 11/1993 |
| JP | 2001-271198 | A | 10/2001 |
| JP | 2003-229191 | A | 8/2003 |

* cited by examiner

*Primary Examiner* — Mohamad Musleh
*Assistant Examiner* — Ronald Hinson
(74) *Attorney, Agent, or Firm* — Birch, Stewart, Kolasch & Birch, LLP

(57) ABSTRACT

An electric terminal member includes a connector portion (4), a wire connecting portion (6) spaced apart from the connector portion and lying parallel to the connector portion, and a bridge portion (8) extending between one end of the connector portion and one end of the wire connecting portion in a direction transverse to any one of the connector and wire connecting portions and for connecting the connector portion with the wire connecting portion. The wire connecting portion has a retaining hole (12). The wire connecting portion also has a flux applying surface (18) and a wire holding surface (16) opposite to each other, the flux applying surface facing towards the connector portion whereas the wire holding surface faces in a direction away from the connector portion.

14 Claims, 3 Drawing Sheets

TERMINAL MEMBER AND COIL ASSEMBLY USING THE SAME

This application is a Continuation of copending PCT International Application No. PCT/JP2007/001198 filed on Nov. 1, 2007, which designated the United States, and on which priority is claimed under 35 U.S.C. §120. This application also claims priority under 35 U.S.C. §119(a) on Patent Application No(s). 2006-299354 filed in Japan on Nov. 2, 2006, the entire contents of each of the above documents is hereby incorporated by reference into the present application.

BACKGROUND OF THE INVENTION

1. Field of the Invention

The present invention relates to an electric terminal member and also to a coil assembly utilizing such terminal member.

2. Description of the Prior Art

Electric wires largely employed in practice are generally made of copper. However, aluminum has a good electroconductivity and inexpensive as compared with copper and, accordingly, if aluminum is used for electric wires and/or coil windings, some advantages can be appreciated.

Even though the electric wires or coil windings are made of aluminum, it is not infrequently required for those electric wires or coil windings to be electrically welded or soldered to existing electric terminal members or wires made of copper. However, by the reasons which will be described subsequently, soldering of the aluminum wires or coil windings to the copper based terminal member or wires has generally considered difficult to achieve.

In the first place, when a soldering material of a copper-tin system is used in connecting an aluminum wire electrically with a copper wire, electric erosion tends to occur in the aluminum wire due to the potential difference which will develop when the circuit including the aluminum wire connected with the copper wire is in use. Also, if a soldering material of a zinc-tin system is used for the same purpose, an oxide layer tends to be formed on the surface of the aluminum, which leads to a rejection of the soldering material used. Although a method has been contemplated, in which soldering is performed under a vacuum atmosphere in order to avoid formation of the oxide layer referred to above, this method is so costly as to render it remote from the practical utilization.

Another method has been suggested, in which in order for a soldered connection to be achieved between the aluminum conductor and the copper wire, a copper plated layer is continuously formed by means of a copper electroplating process on an outer surface of the zinc layer, which has been formed on the surface of the aluminum conductor by means of a zinc substitution process. See, for example, the Japanese Laid-open Patent Publication No. 2001-271198, published Oct. 2, 2001, which discloses a copper coated aluminum wire. It has, however, been found that this technique requires the use of a complicated electroplating process.

In addition, where in order to remove the oxide layer on the aluminum surface, a flux is applied to the aluminum surface prior to soldering by dipping, immersion of aluminum into a soldering bath causes an abrupt increase of the temperature, resulting in scattering of the applied flux. This leads to such a problem that no soldering can be achieved successfully.

SUMMARY OF THE INVENTION

In view of the foregoing, the present invention is intended to provide an electric terminal member that is easy to manufacture and effective to achieve a firm soldering with aluminum.

It is a related object of the present invention to provide a coil assembly utilizing the terminal member of the structure referred to above.

In order to accomplish the foregoing and other objects, the present invention provides an electric terminal member for connection with an electric wire, which member includes a connector portion, a wire connecting portion spaced apart from the connector portion and lying parallel to the connector portion, and a bridge portion extending between one end of the connector portion and one end of the wire connecting portion in a direction transverse to any one of the connector and wire connecting portions and for connecting the connector portion with the wire connecting portion. The wire connecting portion has a retaining hole defined therein so as to extend completely through the thickness of the wire connecting portion. The wire connecting portion also has first and second surfaces opposite to each other, the first surface facing towards the connector portion whereas the second surface faces in a direction away from the connector portion. The first surface of the wire connecting portion is utilized as a flux applying surface for supporting a flux applied thereto and the second surface thereof is utilized as a wire holding surface for supporting the electric wire connected thereto.

According to the present invention, the flux applying surface of the wire connecting portion is defined on a rear side opposite to the wire holding surface of the same wire connecting portion and, on the other hand, the retaining hole defined in the wire connecting portion has one end open on the first surface of the wire connecting portion, that is, the flux applying surface thereof. Accordingly, the flux, when applied to the flux applying surface, flows in part into the retaining hole and is therefore retained within the retaining hole, so that the flux will not scatter by the effect of an abrupt increase of temperature when the wire holding surface is subsequently immersed or dipped into the soldering bath.

In view of the above, that part of the flux retained within the retaining hole in the wire connecting portion, after having been heated gradually by thermal conduction to melt or liquefy, contacts the electric wire through the retaining hole and, accordingly, an outer surface of an end portion of the wire, that is to be connected with the wire connecting portion of the terminal member, can be sufficiently activated enough to accomplish a firm soldering of that end portion of the electric wire to the wire connecting portion of the terminal member.

Also, in the terminal member of the present invention, the connector portion and the wire connecting portion are spaced apart from each other a distance corresponding to the length of the bridge portion and, accordingly, even when the wire connecting portion is immersed or dipped into the soldering bath, the connector portion can be protected from being deposited with soldering material. In addition, with the terminal member of the structure designed in accordance with the present invention, there is no need to create a vacuum condition for the soldering to be accomplished thereunder nor to employ a wire plating process and, accordingly, manufacture can be facilitated.

In one preferred embodiment of the present invention, the wire connecting portion of the terminal member may have a crimping pawl for holding the electric wire assuredly relative to the wire holding surface. The use of the crimping pawl is particularly advantageous in that the electric wire can be assuredly held by the wire holding surface enough to prevent the electric wire from being separated from the wire holding surface during the soldering taking place, thus facilitating the soldering work.

In another preferred embodiment of the present invention, the use of the retaining hole in a plural number is desirable.

The use of the plural retaining holes in the wire connecting portion is effective to avoid an undesirable effusion or spillage of the applied flux completely from the flux applying surface even when the terminal member is tilted. Accordingly, with the terminal member of the present invention, the soldering can be accomplished assuredly.

The present invention also provides a coil assembly, which includes at least one terminal member of the structure referred to above, and a coil having an aluminum winding and also having a lead line drawn from the aluminum winding, the terminal member having the wire connecting portion connected with the lead line of the coil. This aspect of the present invention is effective to provide an inexpensive and lightweight coil assembly utilizing the aluminum winding.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF THE PREFERRED EMBODIMENTS

A preferred embodiment of the present invention will now be described in detail with particular reference to the accompanying drawings.

Figure 1:
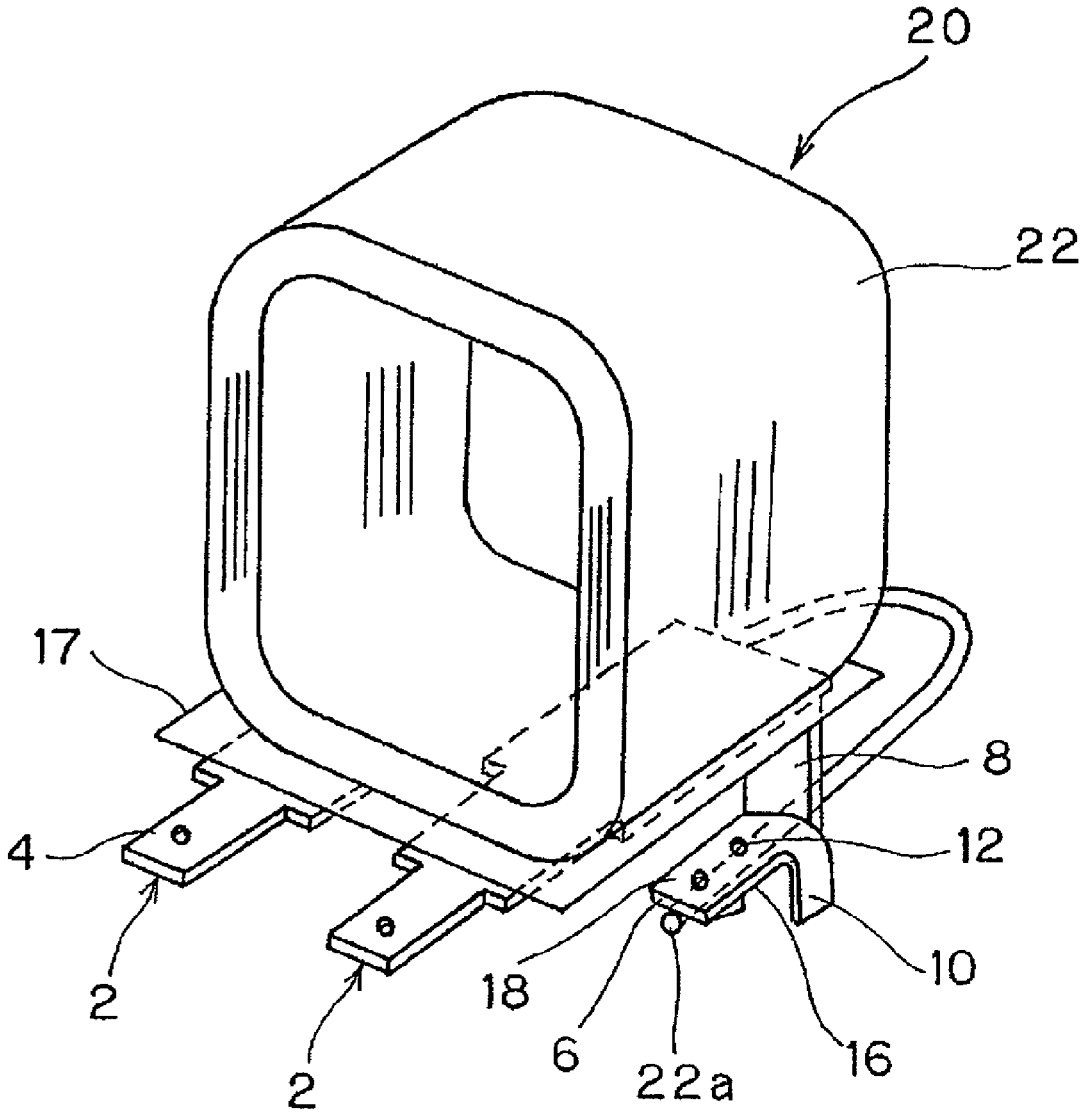
FIG. 1 is perspective view of a coil assembly utilizing terminal members in accordance with a preferred embodiment of the present invention.

FIG. 1 illustrates in a perspective view a coil assembly 20 utilizing two terminal members 2 each designed in accordance with the preferred embodiment of the present invention. The coil assembly 20 is of a kind that is utilized in an electric appliance such as, for example, an electric reactor and includes a coil 22 formed by winding an aluminum thin wire and a pair of terminal members 2 connected respectively with opposite ends of the aluminum thin wire used to form the coil 22. An electrically insulating sheet 17 such as a paper is interposed between the coil 22 and each of the terminal members 2, and lead lines 22*a* of the coil 22, drawn respectively from the opposite ends of the aluminum wire, are connected with respective wire holding surfaces 16, which form lower surfaces of the terminal members 2, as will be described in detail later.

Figure 2:
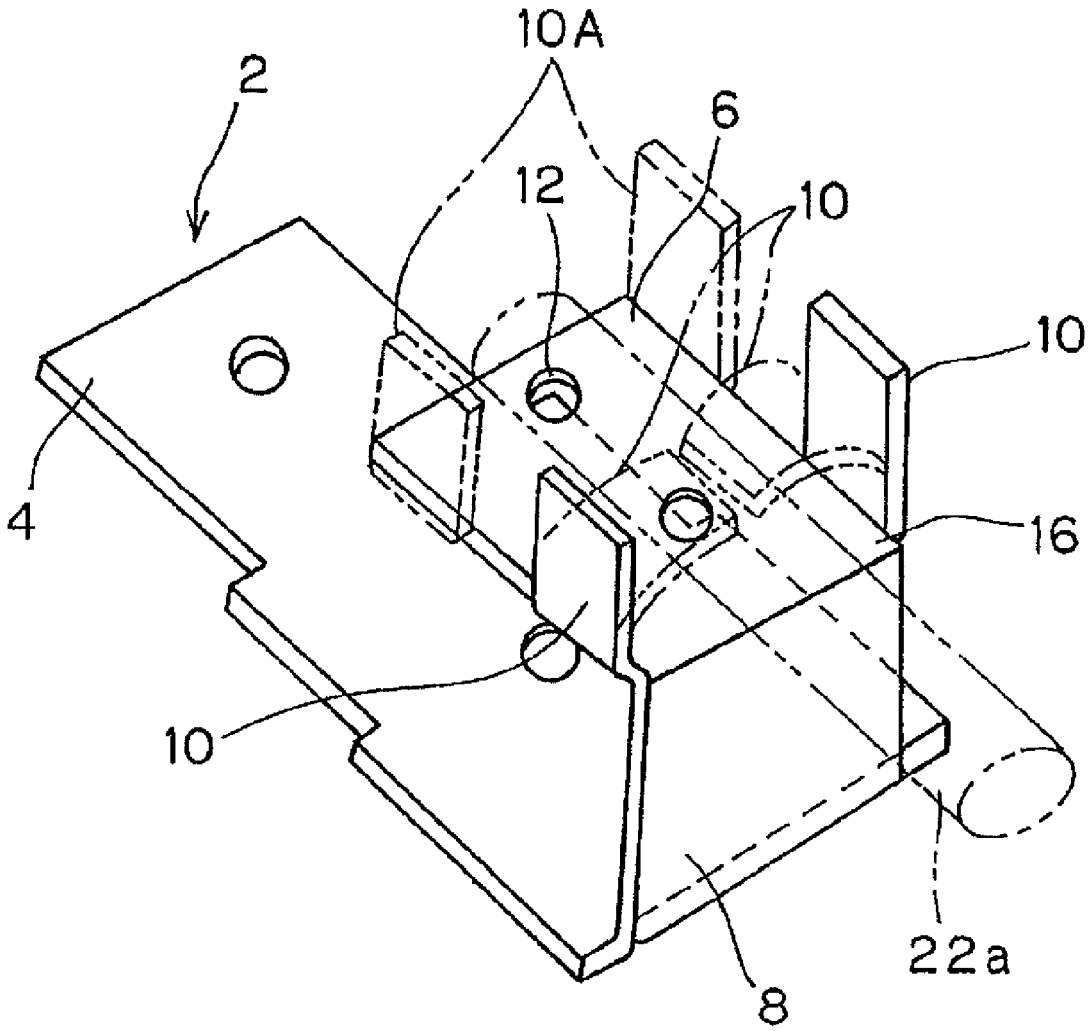
FIG. 2 is a perspective view, on a somewhat enlarged scale, showing one of the terminal members of the present invention as viewed from bottom.

As best shown in FIG. 2 in a perspective representation with one of the terminal members 2 shown as viewed from bottom, each of the terminal members 2 includes a generally elongated rectangular connector portion 4, a generally rectangular wire connecting portion 6 extending parallel to the connector portion 4 and a generally rectangular bridge portion 8 having its opposite ends rigidly connected with, or otherwise formed integrally with, respective one ends of the connector portion 4 and wire connecting portion 6 so as to lie perpendicular to any one of the connector and wire connecting portions 4 and 6. The connector portion 4 and the wire connecting portion 6 are held parallel to each other and extend substantially orthogonal to the bridge portion 8, and have free ends at the respective other ends thereof. The free end of the connector portion 4 is used for connection with an extra electric appliance or component part through, for example, a circuit wire or a connector of that appliance or component part.

The wire connecting portion 6, shown as positioned below the connector portion 4, has a pair of crimping pawls 10 formed integrally therewith so as to extend downwardly therefrom, as viewed in FIG. 1, in a direction away from the connector portion 4 and also has two round retaining holes 12 both extending completely across the thickness of the connector portion 4. For the purpose of the present invention, the use of at least one retaining hole 12 is sufficient, but the use of the plural retaining holes 12 such as shown is desirable.

Where the plural retaining holes 12 are employed such as in the embodiment now under discussion, those plural retaining holes 12 are preferably disposed in an area of the wire connecting portion 6 spaced a distance away from the bridge portion 8 and in alignment with the longitudinal axis of the wire connecting portion 6.

Each of the terminal members 2 is prepared from a single elongated plate made of a copper alloy such as, for example, brass by the use of any known bending technique. Hence, the respective terminal member 2 is of one-piece construction including the connector portion 4, the wire connecting portion 6, the crimping pawls 10, and the bridge portion 8.

As best shown in FIG. 2, showing the terminal member 2 as viewed from bottom, a lead line 22*a* drawn from a corresponding end of the coil winding is introduced onto a wire holding surface 16 of the wire connecting portion 6, which is a surface thereof remote from the connector portion 4 (i.e., a lower surface when viewed in FIG. 1, but an upper surface when viewed in FIG. 2), and is then fixed in position with the crimping pawls 10 bent inwardly relative to each other as indicated by the phantom lines in FIG. 2. In this way, the lead line 22*a* is immovably connected with the wire connecting portion 6 and is subsequently soldered thereto in a manner as will be described subsequently.

It is to be noted that although the only one pair of the crimping pawls 10 have been shown and described as employed in the foregoing embodiment, another pair of similar crimping pawls may be employed as indicated by the phantom lines 10A in addition to the pair of the crimping pawls 10. In this case, the additional paired crimping pawls 10A are formed integrally with the wire connecting portion 6 in a manner similar to the paired crimping pawls 10, but positioned on one side of the paired crimping pawls 10 remote from the bridge portion 8 in a direction of extension of the lead sire 22*a*. In any event, the number of pairs of crimping pawls that can be employed may not be always limited to one, but two or more pairs thereof may be employed.

Figure 3:
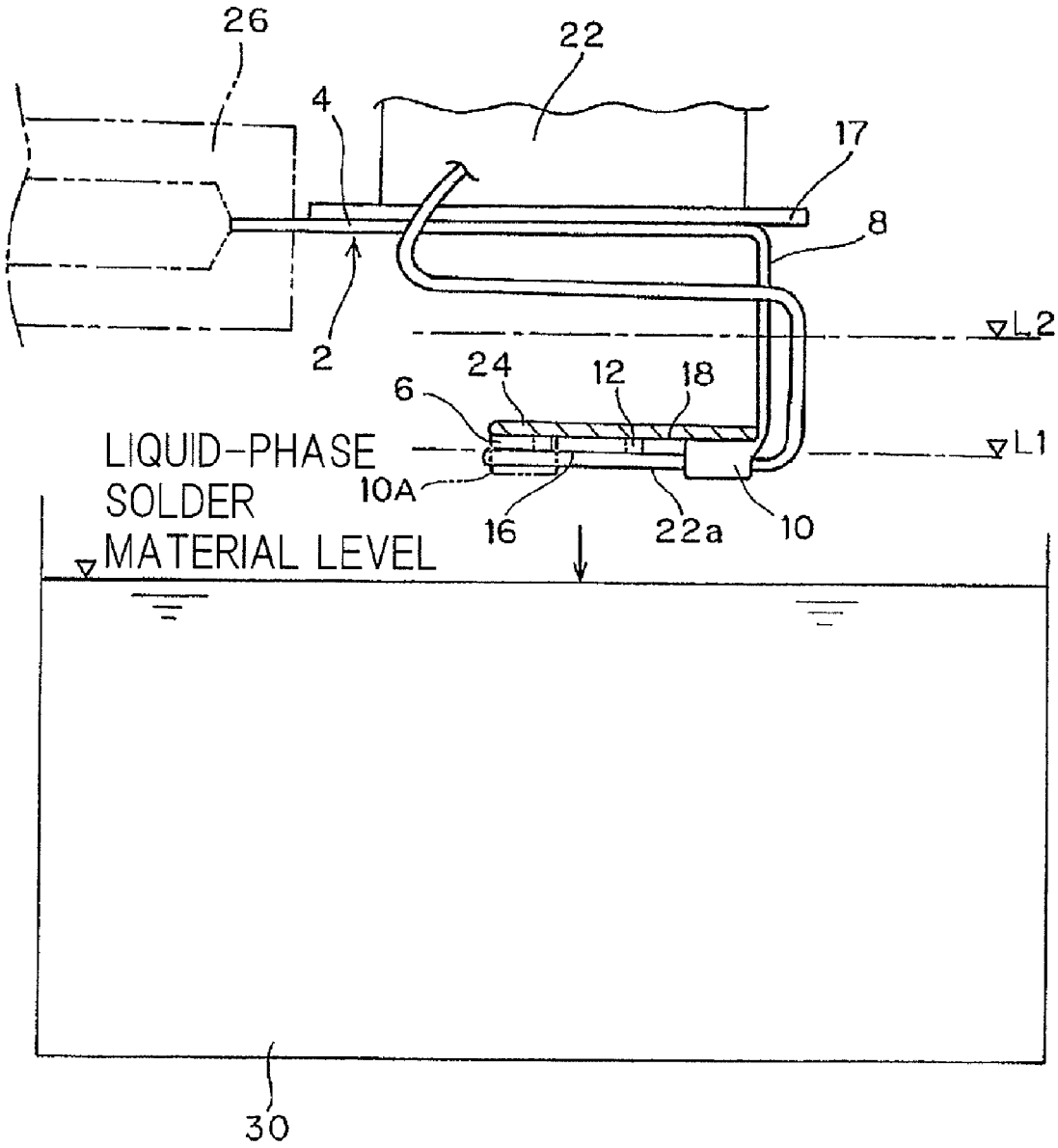
FIG. 3 is a schematic side view, on a somewhat enlarged scale, showing the terminal member shown in FIG. 2.

Referring now to FIG. 3 showing one of the terminal members 2 on a somewhat enlarged scale, the manner of soldering by the use of a soldering machine will be described. The respective lead lines 22*a*, then clamped to the wire connecting portion 6 of each terminal member 2 in the manner described above, are soldered to such wire connecting portion 6 by means of a dip soldering technique. Before the dip soldering is effected, the coil 22 has to be mounted on a surface of the connector portion 4 of each terminal member 2 opposite to the wire connecting portion 6 with the electrically insulating sheet 17 sandwiched between the coil 22 and the connector portion 4, followed by firm positioning of the coil 22 relative to the connector portions 4 of the terminal members 2 by the use of any suitable fixing means such as, for example, a length of tape that is turned therearound.

Thereafter, a flux best shown by 24 in FIG. 3 is deposited on the flux applying surfaces 18 of the wire connecting portions 6 of the respective terminal members 2. As is well known to those skilled in the art, the flux 24 is utilized to activate the respective surfaces of the lead lines 22*a* drawn from the opposite ends of the coil winding forming the coil 22, so that a firm soldering of those lead lines 22*a* with the terminal members 2 can be achieved. This flux 24 is also deposited around the lead lines 22*a*, and the lead lines 22*a* are then clamped to the respective wire connecting portions 6 in contact with the wire holding surfaces 16 thereof by means of the paired crimping pawls 10.

The assembly of the coil 22 connected with the terminal members 2 in the manner described above is mounted on a manipulator in a manner with the respective free ends of the connector portions 4 gripped by a manipulator hand 26 of the soldering machine, and the manipulator hand 26 is then moved downwardly, as viewed in FIG. 3, to allow the terminal members 2 to be immersed a first predetermined depth into a soldering bath 30. The first predetermined depth referred to above is so chosen that the surface of a soldering material in a melt phase relatively comes to a level L1 where substantially only the lead lines 22*a*, supported on the wire holding surfaces 16 of the wire connecting portions 6 of the terminal members 2, can be immersed in the soldering bath, but the fluxes 24 applied to the flux applying surfaces 18 has not yet immersed into the soldering bath 30 nor wetted with the soldering material within the soldering bath 30.

In the condition, in which the assembly of the coil 22 with the terminal members 2 is immersed the first predetermined depth into the soldering bath 30 to allow the surface of the soldering material within the soldering bath 30 to come to the level L1 relative to the terminal members 2 with substantially only the lead lines 22*a* immersed completely within the soldering bath 30, the lead lines 22*a* are abruptly heated to, for example, 300° C. in the instance now under discussion and, therefore, most of the fluxes 24 deposited on the lead lines 22*a* are scattered. On the other hand, the fluxes 24 deposited on the flux applying surfaces 18 are not abruptly heated since they are clear off the surface level of the soldering material within the soldering bath 30, but are gradually heated by the effect of a thermal conduction from the lead lines 22*a* and the terminal members 2 and, therefore, an undesirable scattering of the fluxed 24 on the flux applying surfaces 18 can be suppressed.

Further the manipulator hand 26 is moved downwardly to a portion where the surface of the soldering material within the soldering bath 30 relatively comes to a level L2 and halted. At this position the wire connecting portions 6 of the respective terminal members 2 are completely immersed within the soldering bath together with the lead lines 22*a* described above, but none of the connector portions 4 is immersed within the soldering bath 30. In other words, the assembly of the coil 22 with the terminal members 2 is immersed a second predetermined depth into the soldering bath 30 to such an extent that the surface of the soldering material within the soldering bath 30 comes to the level L2 relative to the terminal members 2. This second predetermined depth is, as a matter of course, greater than the first predetermined depth.

In the condition of the assembly of the coil 22 with the terminal members 2 having been immersed the second predetermined depth into the soldering bath 30, the fluxes 24 heated to an optimum temperature acts on the lead lines 22*a* through the retaining hole 12 and as a result, the respective surfaces of the lead lines 22*a* are activated to facilitate soldering thereof to the respective wire connecting portions 6. The soldering completes when the terminal members 2 are immersed the second predetermined depth below the surface level L2 for 12 to 13 seconds.

It is to be noted that the optimum temperature in the soldering bath 30 referred to above in the illustrated embodiment is preferably within the range of 250 to 500° C. and, more preferably, within the range of 300 to 450° C.

According to the present invention hereinabove fully described, the flux 24 applied to the flux applying surface 18 in each of the terminal members 2 is retained in part within the retaining holes 12 and will not therefore scatter at once when heated to the elevated temperature, but will liquefy enough to flow through the holding holes 12 to contact the surface of the corresponding lead line 22*a* to thereby activate the surface of the lead line 22*a* sufficiently. Also, the provision of the plural holding holes 12 is particularly advantageous in that when the terminal member 2 tilts, the flux 24 can be effectively prevented from flowing downwards from the terminal member 2.

The feature that the connector portion 4 and the wire connecting portion 6 are spaced a distance corresponding to the length of the bridge portion 8, connecting the connector portion 4 and the wire connecting portion 6 together, is particularly advantageous in that even when the wire connecting portion 6 is completely immersed within the soldering bath 30, it is possible to avoid a deposition of the soldering material on the connector portion 4 and/or the coil 22. Also, there is no need to create a vacuum atmosphere nor need to perform a plating process on the connecting wire or any other cable, resulting in facilitation of the soldering.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in the foregoing embodiment of the present invention, the terminal members 2 have been shown and described as used in the coil assembly 20, i.e., fitted to the coil 22, the terminal member or members of the present invention can be utilized as a connector for connecting electric wires together.

Accordingly, such changes and modifications are, unless they depart from the scope of the present invention as delivered from the claims annexed hereto, to be construed as included therein.

What is claimed is:

1. An electric terminal member, comprising:

a connector portion having an upper surface and a lower surface;

a wire connecting portion spaced apart downwardly from the connector portion and lying parallel to the connector portion, the wire connecting portion having a flat plate portion and at least one retaining hole defined therein so as to extend completely through the thickness of the flat plate portion, the flat plate portion having an upper surface facing the lower surface of the connector portion and a lower surface facing away from the connector portion;

a single wire connected to the lower surface of the flat plate portion, the wire covering the at least one retaining hole;

a bridge portion extending between one end of the connector portion and one end of the wire connecting portion in a direction transverse to any one of the connector and wire connecting portions, and for connecting the connector portion with the wire connecting portion; and a plurality of crimping pawls, the crimping pawls being on opposite side edges of the wire connecting portion and extending away from the connector portion.

2. The electric terminal member as claimed in claim 1, wherein the crimping pawls crimp the electric wire to the flat plate portion.

3. The electric terminal member as claimed in claim 1, wherein the at least one retaining hole is a pair of retaining holes, the wire covering the pair of retaining holes.

4. A coil assembly, which comprises the electric terminal member of a structure defined in claim 1, and a coil having an aluminum winding, the wire extending from the coil.

5. The electric terminal member as claimed in claim 1, wherein the elongated connector portion, the wire connecting portion and the bridge portion form a U-shaped member.

6. The coil assembly as claimed in claim 4, wherein the wire connecting portion is positioned below the coil.

7. The coil assembly as claimed in claim 6, wherein the elongated connector portion, the wire connecting portion and the bridge portion form a U-shaped member.

8. The electric terminal member as claimed in claim 1, wherein the elongated connector portion and the wire connecting portion are spaced apart a distance equal to the bridge portion.

9. A coil assembly, comprising:

a coil;

an electric terminal member, the electrical terminal member comprising:

a connector portion having an upper surface and a lower surface;

a wire connecting portion spaced downwardly apart from the connector portion, the wire connecting portion having a flat plate portion and at least one retaining hole defined therein so as to extend completely through the thickness of the flat plate portion, the flat plate portion having an upper surface facing the connector portion and a lower surface facing away from the connector portion;

a bridge portion extending between one end of the connector portion and one end of the wire connecting portion;

the coil being on the upper surface of the connector portion; and a single lead wire extending from the coil and attached to the lower surface of the flat plate portion, the lead wire covering the at least one retaining hole.

10. The coil assembly of claim 9, further comprising an electrical insulator between the coil and the connector portion.

11. The coil assembly of claim 9, wherein the at least one retaining hole is a pair of retaining holes, the wire covering the pair of retaining holes.

12. The coil assembly of claim 9, wherein the at least one retaining hole is configured to retain a soldering flux applied to a surface of the wire connecting portion, the surface to which the soldering flux is applied being close to the connector portion.

13. The electric terminal member of claim 1, wherein the at least one retaining hole is configured to retain a soldering flux applied to a surface of the wire connecting portion, the surface to which the soldering flux is applied being close to the connector portion.

14. The coil assembly of claim 9, further comprising a wire retaining portion extending from the wire connecting portion.

* * * * *